United States Patent [19]

Inoue et al.

[11] Patent Number: 4,957,849

[45] Date of Patent: Sep. 18, 1990

[54] SILVER HALIDE PHOTOGRAPHIC MATERIAL AND IMAGE-FORMING METHOD USING THE SAME

[75] Inventors: Nobuaki Inoue; Senzo Sasaoka, both of Kanagawa, Japan

[73] Assignee: Fuji Photo Film Co., Ltd., Kanagawa, Japan

[21] Appl. No.: 323,059

[22] Filed: Mar. 14, 1989

Related U.S. Application Data

[63] Continuation of Ser. No. 33,375, Apr. 2, 1987, abandoned.

[30] Foreign Application Priority Data

Apr. 2, 1986 [JP] Japan ..... 61-77274
Jul. 1, 1986 [JP] Japan ..... 61-154334

[51] Int. Cl.[5] ..... G03C 1/08

[52] U.S. Cl. ..... 430/264; 430/567; 430/603; 430/605; 430/949

[58] Field of Search ..... 430/567, 949, 264, 571, 430/598, 603, 605

[56] References Cited

U.S. PATENT DOCUMENTS 3,989,527 11/1976 Locker ..... 430/571
4,272,606 6/1981 Mifune et al. ..... 430/949
4,446,228 5/1984 Honda et al. ..... 430/567
4,560,638 12/1985 Loblaw et al. ..... 430/567
4,618,574 10/1986 Cavallaro ..... 430/567
4,650,746 3/1987 Simson et al. ..... 430/567
4,746,593 5/1988 Kitchin et al. ..... 430/264
4,786,587 11/1988 Kuwabara et al. ..... 430/566

FOREIGN PATENT DOCUMENTS 223734 10/1986 Japan .

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide photographic material is disclosed, which comprises a support having provided thereon at least one silver halide emulsion layer and which contains a hydrazine derivative in the emulsion layer or other hydrophilic colloidal layer, the emulsion layer containing two kinds of monodispersed silver halide grains different from each other in mean grain size, and the smaller sized monodispersed silver halide grains being chemically sensitized.

An image-forming method using this photographic material is also disclosed.

16 Claims, No Drawings

SILVER HALIDE PHOTOGRAPHIC MATERIAL AND IMAGE-FORMING METHOD USING THE SAME

This is a continuation of application Ser. No. 033,375, filed Apr. 2, 1987, now abandoned.

FIELD OF THE INVENTION

This invention relates to a silver halide photographic material (particularly the negative-working type) to be used in the field of photomechanical process, which rapidly forms a superhigh contrast image when processed with a highly stable processing solution.

BACKGROUND OF THE INVENTION

Methods by which extremely high contrast photographic images can be produced using certain kinds of silver halides are known and processes of forming such photographic images are employed in the filed of photomechanical process.

For example, it is known that line images or halftone dot images with high contrast and high optical density wherein image portions and non-image portions are clearly discriminated from each other can be obtained by processing lith type silver halide light-sensitive materials comprising silver chlorobromide (containing at least 50 mol % silver chloride) with a hydroquinone developer having an extremely low effective concentration of sulfite ion (usually not more than 0.1 mol/liter). However, the above-described development process is extremely susceptible to air oxidation due to the low sulfite concentration of the developer and, hence, various efforts and techniques have been made and employed for maintaining the stability of the developer.

Therefore, there has been desired an image-forming system which solves the problem of unstable image formation in the above-described development process (lith development system), which provides superhigh-contrast photographic properties when developed with a processing solution having good storage stability. As is seen in U.S. Pat. Nos. 4,166,742, 4,168,977, 4,221,857, 4,224,401, 4,243,739, 4,272,606 and 4,311,781, a system of forming a superhigh contrast negative image of more than 10 gamma has been proposed, which comprises processing a surface latent image-forming silver halide photographic material containing a specific acylhydrazine compound with a developer having a pH of 11.0 to 12.3 containing 0.15 mol/liter or more of a sulfite preservative and having good storage stability. This novel image-forming system is characterized in that, in comparison with the conventional methods of forming a superhigh contrast image, which permits the use of only silver chlorobromide having a high chloride content, it permits the use of silver iodobromide and silver chloroiodobromide as well as silver chlorobromide.

In general, smaller silver halide grains provide higher optical density of silver halide photographic materials per unit amount of developed silver, whereas larger silver halide grains generally provide higher sensitivity. Therefore, in order to obtain light-sensitive materials having high sensitivity and high optical density, it is necessary to incorporate a large-sized silver halide emulsion in as great an amount as possible per unit area. However, light-sensitive materials containing a large amount of silver halide emulsion require a long time for fixing, washing, and drying in development processing and, as a result, rapid processability is sacrificed. In addition, due to high cost and limited yield and deposits of silver, it has been desired to produce light-sensitive materials using silver in as small an amount as possible.

For these reasons, there has been a long-felt need for silver halide photographic materials having high sensitivity and providing high image density using less silver.

On the other hand, the aforesaid novel high contrast negative image-forming system can cause the unfavorable phenomenon of forming black peppers due to infectious development simultaneously with remarkably high speed and high contrast, which has been a problem in photomechanical processes.

The term "black peppers" as used herein means black spots formed of fine silver deposit produced in non-exposed areas which should essentially be white background.

Black peppers often take place when the concentration of sulfite ion generally used in a developer as a preservative is decreased or when pH is increased, which seriously reduces the commercial value of the products as light-sensitive materials for a photomechanical process. Thus, enormous efforts have been made for removing the black peppers. However, techniques for preventing formation of the black peppers are often accompanied by reduction of sensitivity of gamma ($\gamma$). Accordingly, a system has been strongly desired which can prevent black peppers while maintaining high sensitivity and high contrast.

On the other hand, in this field, partial or whole image correction is often conducted by reduction treatment to thereby reduce dot area or thicken or thin the lines or line images for the purpose of reproducing the subtle tone of an original or satisfying artistic expression.

Reducibility is, therefore, an extremely important property required for light-sensitive materials for a photomechanical process. From this viewpoint, too, silver halide photographic materials capable of preventing black peppers and providing high maximum density have been desired.

As one silver halide photographic material having such properties, Japanese Patent Application (OPI) No. 223734/86 discloses a silver halide photographic material containing two kinds of monodispersed emulsions and a hydrazine compound (the term "OPI" as used herein refers to a "published unexamined Japanese patent application"). This light-sensitive material is still insufficient in providing high optical density using less silver.

SUMMARY OF THE INVENTION

An objective of the present invention is to provide a silver halide photographic material which has high sensitivity and which forms images of high contrast (for example, 10 or more gamma) and high optical density, while forming fewer black peppers, and an image-forming process using the photographic material.

Another objective of the present invention is to provide a silver halide photographic material having improved aptitude for reduction treatment.

These and other objectives of the present invention will become apparent from the following description thereof.

The above-described objectives and other objectives of the present invention can be attained by a silver halide photographic material which comprises a support having provided thereon at least one silver halide emulsion layer and which contains a hydrazine derivative in the emulsion layer or at least one other hydrophilic colloidal layer, the emulsion layer containing two kinds of monodispersed silver halide grains different from each other in mean grain size, and the smaller size monodispersed silver halide grains being chemically sensitized; and by an image-forming method which comprises imagewise exposing and developing this light-sensitive material using a developer containing 0.15 mol/liter or more sulfite ion and having a pH of 10.5 to 12.3.

The terminology "mean grain size" as used herein refers to the mean size of all of the silver halide grains present in a particular silver halide emulsion layer. Furthermore, the mean grain size refers to the diameter of the grains when the silver halide grains are spherical or similar to spherical grains, or indicates a calculated diameter value based on projected areas of the grains in the case of non-spherical type grains (e.g., such as cubic grains).

DETAILED DESCRIPTION OF THE INVENTION

The above-described objectives can also be attained to some extent by the method of using a mixture of two kinds of silver halide grains different from each other in grain size disclosed in Japanese Patent Application (OPI) No. 223734/86. However, this method is unable to provide high speed and high Dmax using less silver. On the other hand, the present invention can more effectively attain the above-described objectives by chemically sensitizing the smaller sized silver halide grains.

The larger sized monodispersed grains to be used in the present invention are preferably more sensitive than the smaller sized monodispersed grains but, due to the large grain size, they have the disadvantage of not providing a high optical density per unit amount of silver. Combined use of a larger sized monodispersed emulsion with a chemically sensitized smaller sized monodispersed emulsion provides high sensitivity, high Dmax, and excellent reducibility in comparison with independently using ordinary chemically sensitized grains, as long as the level of the black peppers is about the same.

Extensive study by the inventors has revealed that the phenomenon that combined use of larger sized grains with chemically sensitized smaller sized grains provides remarkable effects is attributed to the fact that infectious development-active seeds produced by development of the larger sized grains permit latent sub-image of the smaller sized grains formed by exposure to be effectively developed and acceleratingly cause infectious development to unexposed grains. Therefore, in rapid processing of 90 seconds to 120 seconds in total processing time measured from insertion to withdrawal of light-sensitive material in an automatic developing machine, development can be conducted with ease. The emulsion comprised of the chemically sensitized smaller sized silver halide grains has a high infectious development activity whereas, with respect to image density, the latent sub-image portion thereof so effectively contributes to image density that high sensitivity and high Dmax can be obtained before black peppers are formed in unexposed portions.

Therefore, in comparison with chemically non-sensitized emulsions which only with difficulty will form latent sub-image, the above-described emulsion is remarkably advantageous in sensitivity and Dmax. The term "latent sub-image" as used herein is well known in the art and means that which forms no image when developed in the absence of a hydrazine derivative but, as will be described hereinafter, forms a substantial image when developed after, for example, gold intensification.

In the present invention, sensitivity of the smaller sized or larger sized silver halide grain emulsions can be more precisely evaluated as follows.

That is, the sensitivity can be determined by coating in sequence a layer comprised of smaller sized and larger sized silver halide grain emulsions containing a hydrazine derivative and a protective layer on a support and developing in the same manner as in Example 1. The amount of silver to be employed for the evaluation may be, for example, 3 g/m$^2$.

The larger sized monodispersed emulsion and the smaller sized monodispersed emulsion to be preferably used in the present invention are not particularly limited as to sensitivity difference but, preferably, the sensitivity difference is preferably 0.1 to 1.0, more preferably 0.2 to 0.7, $\Delta$log E.

As the process for chemical sensitization of smaller sized monodispersed emulsion, known processes such as a sulfur sensitization process, a reduction sensitization process, and a gold sensitization process may be employed alone or in combination. A sulfur sensitization process is the preferable chemical sensitizing process.

As sulfur sensitizing agents, there may be used various sulfur compounds (e.g., thiosulfates, thioureas, thiazoles, rhodanines, etc.) as well as sulfur compounds contained in gelatin. Specific examples thereof are described in U.S. Pat. Nos. 1,574,944, 2,278,947, 2,410,689, 2,728,668, 3,501,313 and 3,656,955. Preferable sulfur compounds include thiosulfates and thiourea compounds and pAg to be employed upon chemical sensitization is preferably not more than 8.3 and more preferably 7.3 to 8.0. In addition, combined use of polyvinyl pyrrolidone and a thiosulfate as reported by Moisar, *Klein Gelatine Proc. Symp.*, 2nd, pp. 301–309 (1970), etc., gives good results.

Of the noble metal sensitization processes, a gold sensitization process is typical and a gold compound, mainly a gold complex salt, is used therein. Complex salts of noble metals other than gold, such as complex salts of platinum, palladium, iridium, etc., may be used. Specific examples thereof are described in U.S. Pat. No. 2,448,060, British Patent No. 618,061, etc.

In the present invention, a silver halide solvent such as potassium thiocyanate, thioether, or surface conversion with KI may also be employed for chemical sensitization. In addition, chemical sensitization may be conducted in the presence of a sensitizing dye or a stabilizing agent (e.g., tetraazaindene).

Since larger sized grains are generally liable to produce black peppers, they are preferably not chemically sensitized or, if chemically sensitized, a technique for preventing the formation of black peppers is preferably employed. For example, there is the technique of lightly conducting chemical sensitization and the technique of preventing formation of black peppers with rhodium, etc. The term "lightly conducting chemical sensitization" as used herein means to shorten the chemical sensitizing time in comparison with sensitizing smaller sized grains or to reduce the amount of chemical sensitizing agent to be added. In the case of using rhodium, rhodium is preferably added during formation of grains. Preferable rhodium compound is rhodium ammonium chloride, and the amount thereof to be added is preferably in the range of from $1\times10^{-8}$ to $8\times10^{-6}$ mol per mol of silver.

In the present invention, the degree of chemical sensitization adopted to achieve the objectives of the present invention can be evaluated by whether or not a latent sub-image is formed or by the degree of formation of a latent sub-image. Presence of a latent sub-image can be confirmed by the gold intensification process as reported by T. H. James, *J. Colloid. Sci.*, 3, 447 (1948). For example, films which have been subjected to the aforesaid sensitivity evaluation are exposed through a step wedge of 0.1 density difference between steps and, after dipping in a gold intensifier of formulation A shown below at 20° C. for 10 minutes, washed for 10 minutes with running water. Then they are developed at 38° C. for 20 seconds using a developer of formulation B shown below to evaluate the latent sub-image-forming properties. Chemically sensitized emulsions liable to form a latent sub-image show a remarkable increase in sensitivity (Δlog E) in comparison with chemically non-sensitized emulsions. The term "an increase in sensitivity" as used herein means Δlog E= [sensitivity obtained by processing in developer B at 38° C. for 20 seconds after pretreatment with gold intensifier A (logarithm of an exposure amount giving a density of 1.5)]−[sensitivity obtained by processing in developer B at 38° C. for 20 seconds].

| | |
|---|---|
| Gold Intensifier A | |
| Chloroauric Acid (0.1%) | 40 ml |
| Potassium Thiocyanate | 0.5 g |
| $H_2O$ to make | 1 liter |
| Developer B | |
| Hydroquinone | 23 g |
| 1-Phenyl-3-pyrazolidone | 0.4 g |
| Sodium Sulfite | 67 g |
| Potassium Hydroxide | 11 g |
| Sodium Carbonate | 11 g |
| Potassium Bromide | 3.0 g |
| Water to make | 1 liter |
| | (pH = 10.4) |

The increase in sensitivity of larger sized grains measured by the above-described gold intensification process is preferably less than 0.4, more preferably 0.1 to 0.3, Δlog E, whereas the increase in sensitivity of smaller sized grains is preferably 0.4 or more, more preferably 0.5 to 0.7, Δlog E.

The silver halide emulsions to be used in the present invention are not particularly limited as to halide composition and silver halide emulsions comprised of any of silver chloride, silver bromide, silver chlorobromide, silver iodobromide, silver iodochloride, and silver iodochlorobromide may be employed. The silver halide compositions of the two kinds of emulsions may be the same or different.

The silver halide emulsions used in the present invention may be prepared by any of the methods known in the art of silver halide photographic materials, such as those described in P. Glafkides, *Chimie et Physique Photographique,* Paul Montel Co., Paris (1967); G. F. Duffin, *Photographic Emulsion Chemistry,* The Focal Press, London (1966); and V. L. Zelikman et al., *Making and Coating Photographic Emulsion,* The Focal Press, London (1964). Furthermore, the silver halide emulsions and the processes for preparing the same are described in detail in *Research Disclosure,* Vol. 176, No. 17643, pages 22–23 (December, 1978).

The mean grain size of smaller sized silver halide grains to be used in the present invention is preferably 90% or less, more preferably 80% or less, of that of larger sized silver halide grains.

The mean grain size of silver halide grains to be used in the present invention preferably falls within the range of from 0.02 μm to 0.5 μm, more preferably 0.11 μm to 0.4 μm. It is preferable that the mean grain sizes of both the larger sized monodispersed grains and the smaller sized monodispersed grains fall within the above-described range. Grains of 0.7 μm or more in mean grain size as disclosed in Japanese Patent Application (OPI) No. 581371/82 are not preferable, since they produce a serious black pepper problem.

In the present invention, the smaller sized monodispersed emulsion is coated in a coated silver amount of preferably 40 to 90 wt %, more preferably 50 to 80 wt %, based on the amount of the total coated silver.

As a method of introducing monodispersed emulsions different in grain size, it is preferable to introduce them in the same emulsion layer.

Additionally, the total coated silver amount is preferably 1 g/m$^2$ to 8 g/m$^2$ The water-soluble silver salt (an aqueous solution of silver nitrate) may be reacted with a water-soluble halide salt by either the single jet method, the double jet method or a combination thereof. One application of the double jet method is what is called the "controlled double jet method" wherein the pAg is held constant in a liquid phase where silver halide is being formed. Silver halide grains may also be formed by using a "silver halide solvent" such as ammonia, thioether, or tetrasubstituted thiourea.

Grain formation by the controlled double jet method using a silver halide solvent allows easy preparation of a silver halide emulsion having a regular crystal shape and a narrow grain size distribution, and hence is an effective means for obtaining an emulsion that is suitable for use in the present invention.

The monodispersed emulsions to be used in the present invention preferably contain grains of regular crystal form such as cubic form, octahedral form, or tetradecahedral form, with cubic form and tetradecahedral form being particularly preferable.

The monodispersed emulsions to be used in the present invention are emulsions which have such grain distribution that 90% of the number of whole grains have grain sizes falling within ±40%, preferably ±20%, of the mean grain size.

The silver halide grains may comprise the inner portion and the surface layer portion which may be the same as or different from each other in phase composition.

In preparing the silver halide emulsions to be used in the present invention, cadmium salts, sulfite salts, lead salts, thallium salts, rhodium salts or complex salts thereof, iridium salts or complex salts thereof may be allowed to coexist during the formation or physical ripening of the silver halide grains.

In the present invention, silver halide emulsions particularly adopted for preparing light-sensitive materials for photographing line images or for forming halftone dots are prepared by allowing an iridium salt or a complex salt thereof to coexist in an amount of $10^{-8}$ to $10^{-5}$ mol per mol of silver, and silver halide grains containing 70 mol % or more, particularly 90 mol % or more, of silver bromide is preferable. The content of silver iodide is preferably up to 10 mol %, particularly preferably 0.1 to 5 mol %, and silver haloiodide grains wherein the content of silver iodide in the grain surface is more than the average iodide content of the grains are preferable. Emulsions having such silver haloiodide provide photographic properties of high sensitivity and high gamma.

In the case of using silver chlorobromide, silver halide comprising 50 mol % or more, particularly 70 mol % or more, of silver bromide is preferable.

In the above description, the iridium salt is desirably added in the above-described amount before completion of physical ripening in the process of preparing the silver halide emulsion, particularly upon the formation of grains.

The iridium salts to be used here are water-soluble iridium salts or iridium complex salts, and are exemplified by iridium trichloride, iridium tetrachloride, potassium hexachloroiridate (III), potassium hexachloroiridate (IV), ammonium hexachloroiridate (III), etc.

Preferable examples of hydrazine derivatives which may be used in the present invention are the arylhydrazides of the type described in U.S. Pat. No. 4,478,928 wherein the sulfinic acid residue is bonded to the hydrazo portion, and compounds represented by formula (I)

$$R_1\text{-NHNH-G-}R_2 \qquad (I)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group.

The aliphatic group denoted by $R_1$ in formula (I) preferably has 1 to 30 carbon atoms, with a straight chained, branched or cyclic alkyl group having from 1 to 20 carbon atoms being particularly preferable. The branched alkyl group may be cyclized in such a manner that a saturated hetero ring containing one or more hetero atoms may be formed. The alkyl group may have a substituent such as an aryl, alkoxy, sulfoxy, sulfonamido or carbonamido group.

The aromatic group denoted by $R_1$ is a monocyclic or bicyclic aryl group or an unsaturated hetero cyclic group, the latter being optionally condensed with a mono- or bicyclic aryl group to form a heteroaryl group. Illustrative aromatic groups include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, and those which contain a benzene ring are particularly preferable.

An aryl group is particularly preferable as $R_1$. The aryl group or unsaturated heterocyclic group as $R_1$ may have a substituent and typical substituents include a straight chained, branched, or cyclic alkyl group (preferably having from 1 to 20 carbon atoms), an aralkyl group (which is preferably a mono- or bicyclic aralkyl group wherein the alkyl moiety has 1 to 3 carbon atoms), an alkoxy group (preferably having from 1 to 20 carbon atoms), a substituted amino group (preferably one which is substituted by an alkyl group with from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

The alkyl group denoted by $R_2$ is preferably one having from 1 to 4 carbon atoms and may have a substituent such as a halogen atom, a cyano group, a carboxy group, a sulfo group, an alkoxy group or a phenyl group.

The optionally substituted aryl group denoted by $R_2$ is a mono- or bicyclic aryl group which may contain a benzene ring. This aryl group may be substituted by, for example, a halogen atom, an alkyl group, a cyano group, a carboxyl group, or a sulfo group.

The optionally substituted alkoxy group denoted by $R_2$ is one having from 1 to 8 carbon atoms and may be substituted, for example, by a halogen atom or an aryl group.

The optionally substituted aryloxy group denoted by $R_2$ is preferably monocyclic and may have a substituent such as a halogen atom.

Preferable examples of the group denoted by $R_2$ are listed below: when G is a carbonyl group, they are a hydrogen atom, a methyl group, a methoxy group, an ethoxy group, a substituted or unsubstituted phenyl group, with the hydrogen atom being particularly preferable; when G is a sulfonyl group, preferable examples of $R_2$ are a methyl group, an ethyl group, a phenyl group, or a 4-methylphenyl group, with the methyl group being particularly preferable; when G is a phosphoryl group, preferable examples of $R_2$ are a methoxy group, an ethoxy group, a butoxy group, a phenoxy group, and a phenyl group, with the phenoxy group being particularly preferable; when G is a sulfoxy group, preferable examples of $R_2$ are a cyanobenzyl group and a methylthiobenzyl group; and when G is an N-substituted or unsubstituted iminomethylene group, preferable examples of $R_2$ are a methyl group, an ethyl group, and a substituted or unsubstituted phenyl group.

A ballast group which is commonly employed in couplers and other immobile photographic additives may be incorporated in $R_1$ or $R_2$ The ballast group is one having at least 8 carbon atoms which is comparatively inert to photographic properties; a suitable ballast group may be selected from among alkyl, alkoxyl, phenyl, alkylphenyl, phenoxy and alkylphenoxy groups.

A group which provides enhanced adsorption to the surface of silver halide grains may also be incorporated in $R_1$ or $R_2$. Illustrative adsorptive groups include a thiourea group, a heterocyclic thioamido group, a mercapto heterocyclic group and a triazole group, and such are described in U.S. Pat. No. 4,385,108.

A carbonyl group is most preferable as G in formula (I).

Specific examples of the compounds represented by formula (I) are listed below, but it should be noted that these examples of compound (I) do not limit the scope of the present invention.

(I-1)

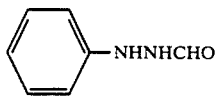

-continued
(I-2)
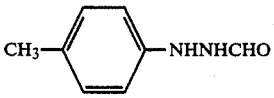
(I-3)
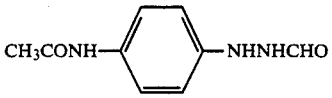
(I-4)
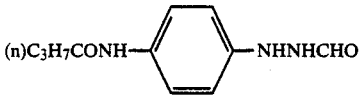
(I-5)
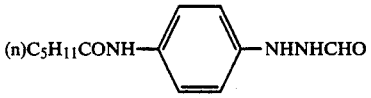
(I-6)
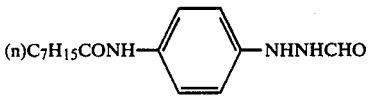
(I-7)
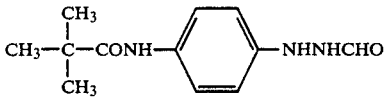
(I-8)
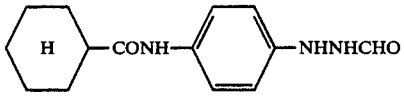
(I-9)
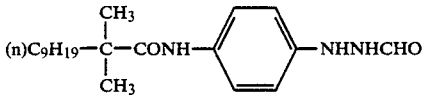
(I-10)
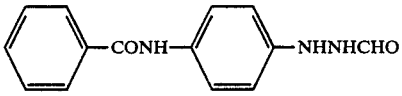
(I-11)
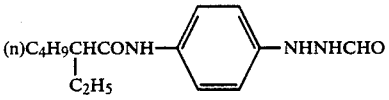
(I-12)
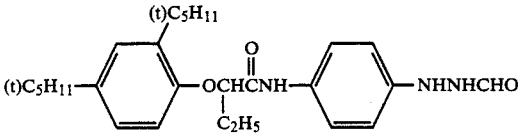
(I-13)
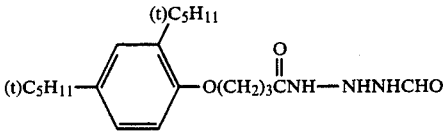
(I-14)
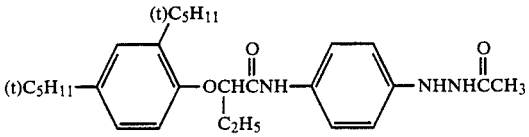

-continued
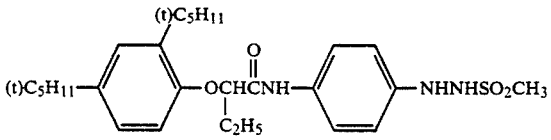
(I-15)
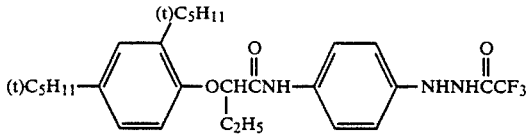
(I-16)
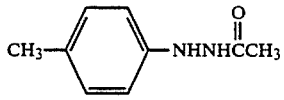
(I-17)
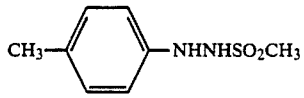
(I-18)
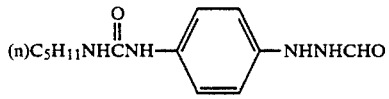
(I-19)
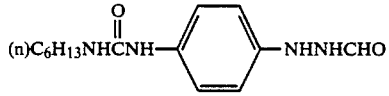
(I-20)
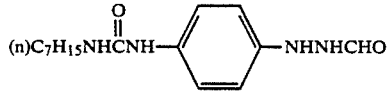
(I-21)
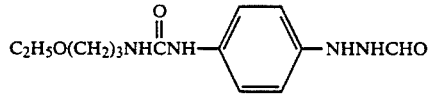
(I-22)
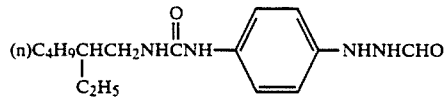
(I-23)
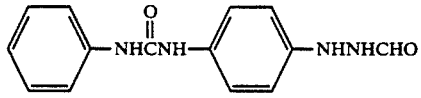
(I-24)
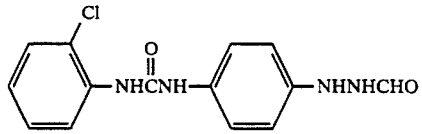
(I-25)
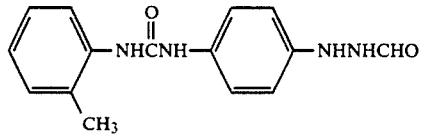
(I-26)

-continued
(I-27)
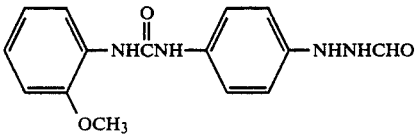
(I-28)
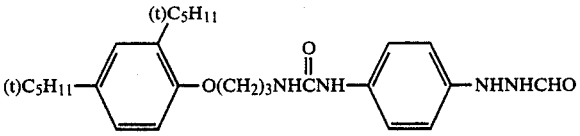
(I-29)
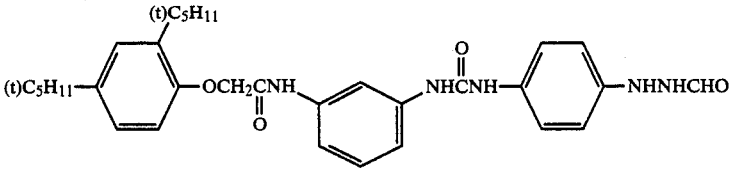
(I-30)
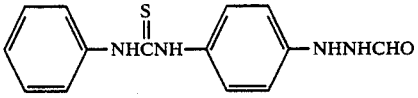
(I-31)
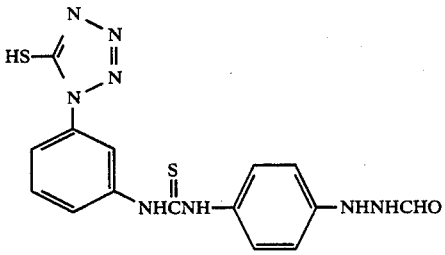
(I-32)
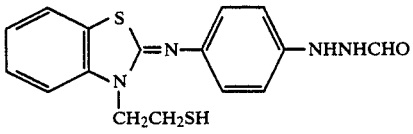
(I-33)
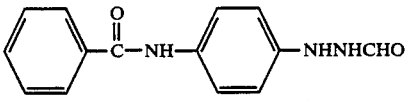
(I-34)
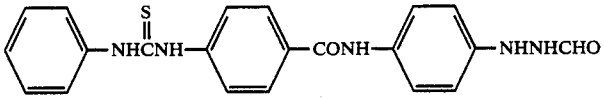
(I-35)
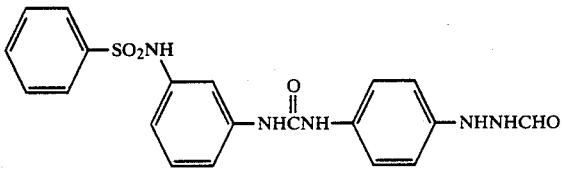

-continued
(I-36)
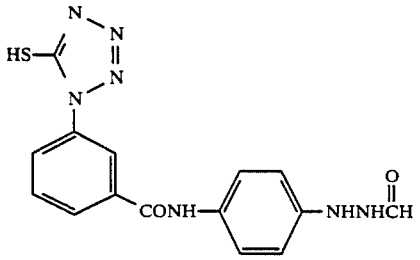
(I-37)
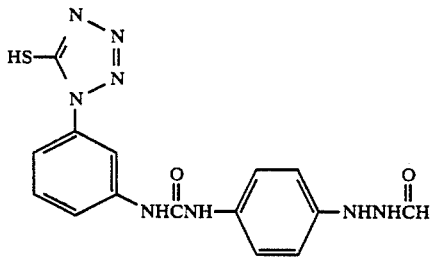
(I-38)
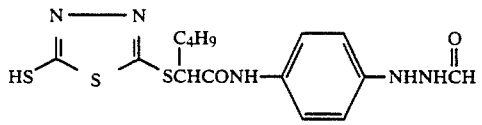
(I-39)
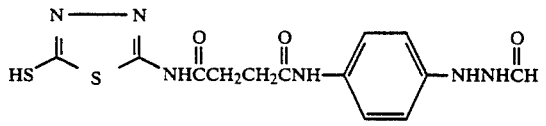
(I-40)
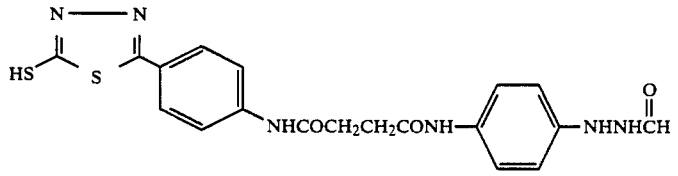
(I-41)
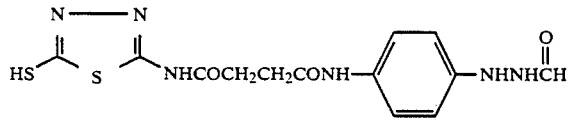
(I-42)
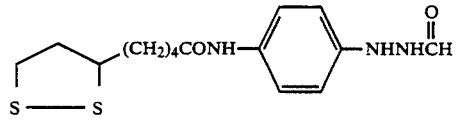
(I-43)
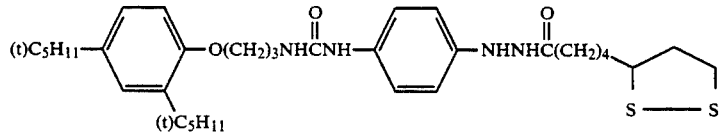
(I-44)
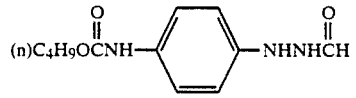

-continued (I-45)

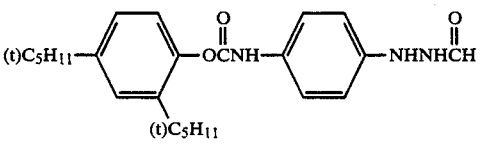

(I-46)

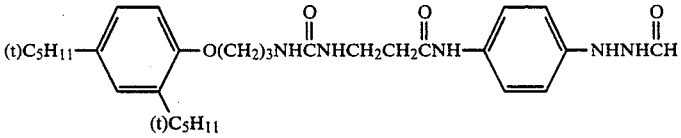

(I-47)

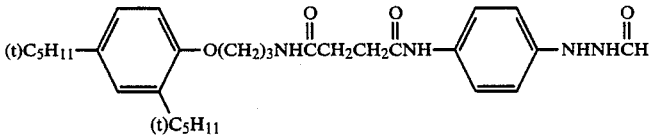

(I-48)

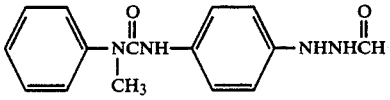

(I-49)

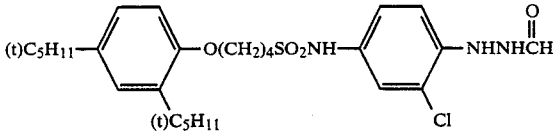

(I-50)

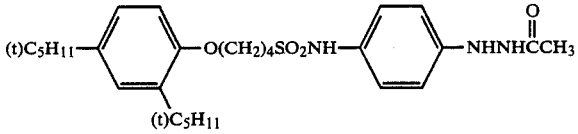

(I-51)

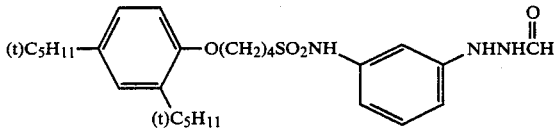

As the hydrazine derivatives to be used in the present invention, those which are described in *Research Disclosure*, No. 23516 (November, 1983), p. 346 and literature cited therein, U.S. Pat. Nos. 4,080,207, 4,269,929, 4,276,364, 4,278,748, 4,385,108, 4,459,347, 4,560,638, 4,478,928, British Patent No. 2,011,391B, Japanese Patent Application (OPI) No. 179734/85 may also be used as well as the above-mentioned compounds.

The compounds represented by general formula (I) are incorporated in an amount of preferably $1\times10^{-6}$ mol to $5\times10^{-2}$ mol, particularly $1\times10^{-5}$ to $2\times10^{-2}$ mol, per mol of total silver halide.

The compounds represented by general formula (I) may be incorporated in photographic light-sensitive materials by adding them to a silver halide emulsion solution (an emulsion comprised of coarse grains, an emulsion comprised of fine grains, or the like) or to a hydrophilic colloidal solution as an aqueous solution (with water-soluble compounds) or as a solution of a water-miscible organic solvent such as an alcohol (e.g., methanol, ethanol, etc.), an ester (e.g., ethyl acetate) or a ketone (e.g., acetone) with water-insoluble compounds.

In the case of adding the compound to a silver halide photographic emulsion solution, the addition may be conducted at any stage between initiation of chemical ripening and coating of the solution, but preferably is conducted after completion of chemical ripening. Particularly preferably, the solution is added to a coating solution prepared to be coated.

To the light-sensitive material to be used in the present invention may be added those sensitizing dyes which are described in Japanese Patent Application (OPI) No. 52050/80, pp. 45–53 (for example, cyanine dyes, merocyanine dyes, etc.) for the purpose of increasing sensitivity.

These sensitizing dyes may be used alone or in combination. A combination of sensitizing dyes is often used particularly for supersensitization. A dye which itself does not have a spectral sensitizing effect or a substance which substantially does not absorb visible light and yet shows the supersensitizing effect may be incorporated in the emulsion together with the sensitizing dye.

Useful sensitizing dyes, combinations of dyes showing supersensitizing effect, and substances showing the supersensitizing effect are described in *Research Disclo-*

*sure*, Vol. 176, No. 17643 (December, 1978), p. 23, IV-A to IV-J, in addition to the aforementioned literature.

The sensitizing dyes and the like may be added to photographic emulsions at any process of the process of preparing the emulsions, or may be added at any stage after preparation and before coating of the emulsions. In the former case, the addition may be conducted, for example, upon formation of grains, physical ripening or chemical ripening.

The photographic emulsion used in the present invention may contain various compounds for the purpose of preventing the occurrence of fogging during the manufacture, storage or photographic processing of the light-sensitive material or for stabilizing its photographic performance. Many compounds that are known in the art as antifoggants or stabilizers may be used for these purposes and they include: azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (e.g., 1-phenyl-5-mercaptotetrazole); mercaptopyrimidines; mercaptotriazines; thioketo compounds such as oxazolinethione; azaindenes such as triazaindenes, tetraazaindenes (e.g., 4-hydroxy-substituted (1,3,3a,7)-tetraazaindenes) and pentaazaindenes; benzenethiosulfonic acid, benzenesulfinic acid and benzenesulfonic acid amide.

Of these compounds, benzotriazoles (e.g., 5-methylbenzotriazole) and nitroindazoles (e.g., 5-nitroindazole) are particularly preferable. These compounds may be incorporated in a processing solution.

The photographic material of the present invention may contain inorganic or organic hardening agents in photographic emulsion layers or other hydrophilic colloidal layers. Suitable hardening agents, which may be used either independently or in combination, include: chromium salts (e.g., chrome alum and chromium acetate), aldehydes (e.g., formaldehyde, glyoxal and glutaraldehyde), N-methylol compounds (e.g., dimethylolurea and methylol-dimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g. 2,4-dichloro-6-hydroxy-s- triazine), and muchohalogenic acids (e.g., mucochloric acid and mucophenoxychloric acid). Of these, active vinyl compounds described in Japanese Patent Application (OPI) Nos. 41221/78, 57257/78, 162546/84 and 80846/85 and active halogen compounds described in U.S. Pat. No. 3,325,287 are preferable.

The photographic emulsion layers and other hydrophilic colloidal layers in the light-sensitive material that is prepared in accordance with the present invention may contain various surface active agents for attaining various purposes such as, for example, assisting coating operations, improving antistatic properties, providing improved sliding properties, achieving emulsification or dispersion, preventing adhesion and providing improved photographic characteristics (e.g., accelerating the rate of development, increasing contrast, or providing sensitization). Suitable surface active agents are listed below: nonionic surfactants such as saponin (steroid type), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines or amides, and polyethylene oxide adducts of silicone) glycidol derivatives (e.g., alkenyl-succinic acid polyglycerides and alkylphenol polyglycerides), aliphatic acid esters of polyhydric alcohols, and alkyl esters of saccharides; anionic surfactants containing acidic groups such as a carboxyl group, a sulfo group, a phospho group, a sulfate group, or a phosphate group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyl-taurines, sulfosuccinic acid esters, sulfoalkylpolyoxyethylene alkylphenyl ethers, and polyoxyethylene alkyl phosphoric acid esters; amphoteric surfactants such as amino acids, aminoalkylsulfonic acids, aminoalkylsulfate or phosphate esters, alkylbetaines, and amine oxides; and cationic surfactants such as alkylamine salts, aliphatic or aromatic quaternary ammonium salts, heterocyclic quaternary ammonium salts (e.g., pyridinium and imidazolium salts), and aliphatic or heterocyclic phosphonium or sulfonium salts.

Surface active agents which are preferably used in the present invention are the polyalkylene oxides described in U.S. Pat. No. 4,221,857 which have molecular weight of 600 or more.

Where the surface active agents are used as antistatic agents, fluorine-containing surface active agents (described in, for example, U.S. Pat. No. 4,201,586 and Japanese Patent Application (OPI) No. 80849/85) are particularly preferable.

The photographic light-sensitive material of the present invention may contain amines or quaternary onium salt compounds as described in Japanese Patent Application No. 94044/86 for the purpose of accelerating development or nucleation.

The photographic light-sensitive material of the present invention may contain in its photographic emulsion layers or other hydrophilic colloidal layers a matting agent such as silica, magnesium oxide or polymethyl methacrylate.

The light-sensitive material to be used in the present invention may contain a dispersion of a water-soluble or sparingly water-soluble synthetic polymer for improving dimensional stability or other purposes. For example, polymers containing as monomer components alkyl (meth)acrylate, alkoxyalkyl (meth)acrylate, glycidyl (meth)acrylate, etc., alone or in combination, or containing a combination of the above-described monomer or monomers and acrylic acid, methacrylic acid or the like may be used.

The photographic light-sensitive material of the present invention preferably contains a compound having an acidic group in its silver halide emulsion layers and other layers. As the compound having an acidic group, there are illustrated organic acids such as salicylic acid, acetic acid, ascorbic acid, etc., and polymers or copolymers containing as repeating units acid monomers such as acrylic acid, maleic acid, phthalic acid, etc. As to these compounds, reference may be made to Japanese Patent Application (OPI) Nos. 223834/86 and 228437/86 and Japanese Patent Application Nos. 163856/85 and 195655/85. Of these compounds, ascorbic acid is a particularly preferable low molecular compound and a water-dispersible latex of a copolymer comprised of an acidic monomer such as acrylic acid and a crosslinkable monomer having two or more unsaturated groups such as divinylbenzene is a preferable high molecular compound.

As a binder or protective colloid to be used in the light-sensitive material of the present invention, gelatin is advantageously used, but hydrophilic synthetic polymers may also be used. As gelatin, lime-processed gelatin, acid-processed gelatin, gelatin derivative, etc., may be used as well. Specific descriptions thereof are given in *Research Disclosure*, Vol. 176, No. 17643 (December, 1978), IX.

In the light-sensitive material to be used in the present invention, hydrophilic colloidal layers such as a surface protective layer, an interlayer, a filter layer, an antihalation layer, etc., may be provided in addition to the silver halide emulsion layers.

The protective layer or the like may contain as a matting agent fine grains (for example, 2 to 5 μm) of polymethyl methacrylate homopolymer, methyl methacrylate-methacrylic acid copolymer, starch, silica, etc., described in U.S. Pat. Nos. 2,992,101, 2,701,245, 4,142,894 and 4,396,706 may be used. In addition, the aforesaid surface active agents may be used together.

The surface protective layer may contain as a lubricant a paraffin wax, a higher fatty acid ester, a starch, or the like as well as silicone compounds described in U.S. Pat. Nos. 3,489,576 and 4,047,958 and colloidal silica described in Japanese Patent Publication No. 23139/81.

The hydrophilic colloidal layer may contain as a plasticizer a polyol such as trimethylolpropane, pentanediol, butanediol, ethylene glycol or glycerin.

In obtaining superhigh contrast high speed photographic properties using the silver halide photographic material of the present invention, it is not necessary to use a conventional infectious developer or a highly alkaline developer nearly 13 in pH described in U.S. Pat. No. 2,419,975, and a stable developer may be used.

That is, the silver halide photographic material of the present invention can provide an enough superhigh contrast negative image when processed with a developer containing 0.15 mol/liter or more of sulfite ion as a preservative and having a pH of 10.5 to 12.3, particularly 11.0 to 12.0.

Developing agents to be used in the developer for developing the light-sensitive material of the present invention are not particularly limited, but dihydroxybenzenes are preferable since they are liable to provide good halftone dot quality. In some cases, a combination of a dihydroxybenzene and a 1-phenyl-3-pyrazolidone or a combination of a dihydroxybenzene and a p-aminophenol is employed.

The dihydroxybenzene type developing agents to be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particularly preferable.

As the developing agents of 1-phenyl-3-pyrazolidone or derivative thereof to be used in the present invention, there are illustrated 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, 1-p-tolyl-4-methyl-4-hydroxymethyl-3-pyrazolidone, etc.

The p-aminophenol type developing agents to be used in the present invention include N-methyl-paminophenol, p-aminophenol, N-(B-hydroxyethyl)-p-aminophenol, N-(4-hydroxyphenyl)glycine, 2-methyl-p-aminophenol, p-benzylaminophenol, etc., with N-methyl-paminophenol being particularly preferable.

The developing agent is used in an amount of preferably 0.05 mol/liter to 0.8 mol/liter. In the case of employing a combination of a dihydroxybenzene and a 1-phenyl-3-pyrazolidone or a p-aminophenol, the former is used preferably in an amount of 0.05 mol/liter to 0.5 mol/liter, and the latter in an amount of not more than 0.06 mol/liter.

The preservative of sulfite to be used in the present invention includes sodium sulfite, potassium sulfite, lithium sulfite, ammonium sulfite, sodium bisulfite, potassium metabisulfite, formaldehyde-sodium bisulfite adduct, etc. The sulfite is used in an amount of 0.15 mol/liter or more, particularly preferably 0.4 mol/liter or more. The upper limit of the amount of the sulfite to be used is preferably 2.5 mol/liter, particularly preferably 1.2 mol/liter.

The alkali agents to be used for adjusting pH include pH-adjusting agents or buffer agents such as sodium hydroxide, potassium hydroxide, sodium carbonate, potassium carbonate, sodium tertiary phosphate, potassium tertiary phosphate, sodium silicate, potassium silicate, etc.

As the additives to be used other than the above-described components, such compounds as boric acid, and borax; development restrainers such as sodium bromide, potassium bromide, and potassium iodide; organic solvents such as ethylene glycol, diethylene glycol, triethylene glycol, dimethylformamide, methyl cellosolve, hexylene glycol, ethanol, methanol, etc.; antifoggants or black pepper-preventing agents such as mercapto compounds (e.g., 1-phenyl-5-mercaptotetrazole, 2-mercaptobenzimidazole-5-sulfonic acid sodium salt, etc.), indazole compounds (e.g., 5-nitroindazoles), and benzotriazole compounds (e.g., 5-methylbenzotriazole) and, if necessary, toning agents, surface active agents, defoaming agents, hard water softeners, hardeners, amino compounds described in Japanese Patent Application (OPI) No. 106244/81, etc., may be incorporated.

In the developer to be used in the present invention, compounds described in Japanese Patent Application (OPI) No. 24347/81 may be used as silver stain-preventing agents, compounds described in Japanese Patent Application No. 56629/86 may be used as uneven development-preventing agents, and compounds described in Japanese Patent Application (OPI) No. 267759/86 may be used as dissolving aids.

In the developer to be used in the present invention, boric acid described in Japanese Patent Application No. 28708/86, sugars described in Japanese Patent Application (OPI) No. 93433/85 (for example, saccharose), oximes (for example, acetoxime), phenols (for example, 5-sulfosalicylic acid), tertiary phosphates (for example, sodium salts, potassium salts, etc.), etc., may be used as buffer agents, with boric acid being preferable.

The fixing solution to be used is an aqueous solution containing a fixing agent and, if necessary, a hardener, e.g., a water-soluble aluminum compound), acetic acid, and a dibasic acid (e.g., tartaric acid, citric acid, or a salt thereof) and having a pH of preferably 3.8 or more, more preferably 4.0 to 5.5, most preferably 4.4 to 5.0.

Fixing agents include sodium thiosulfate, ammonium thiosulfate, etc., and ammonium thiosulfate is particularly preferable from the standpoint of fixing speed. The amount of the fixing agent may properly be changed, and is generally about 0.1 to about 5 mol/liter.

Water-soluble aluminum salts functioning mainly as hardeners in the fixing solution are compounds known as hardeners of an acidic hardening and fixing solution and include, for example, aluminum chloride, aluminum sulfate, potash alum, etc.

As the aforementioned dibasic acid, tartaric acid or derivatives thereof and citric acid or derivatives thereof may be used alone or in combination of two or more. These compounds are effectively incorporated in an amount of 0.005 mol or more, more effectively 0.01 mol to 0.03 mol, per liter of the fixing solution.

Specific examples of the dibasic acids include tartaric acid, potassium tartrate, sodium tartrate, potassium sodium tartrate, ammonium tartrate, ammonium potassium tartrate, etc.

Examples of citric acid and the derivatives thereof effective in the present invention include citric acid, sodium citrate, potassium citrate, etc.

The fixing solution may further contain, if desired, a preservative (e.g., a sulfite, bisulfite, etc.), a pH buffer (e.g., acetic acid, boric acid, etc.), a pH-adjusting agent (e.g., ammonia, sulfuric acid, etc.), an image preservability-improving agent (e.g., potassium iodide), and a chelating agent. pH buffers are used in an amount of 10 to 40 g/liter, preferably 18 to 25 g/liter, since the developer has a high pH.

Fixing temperature and time are about the same as are employed in development processing, and are preferably about 20° C. to about 50° C. and 10 seconds to 1 minute, respectively.

Washing water may contain an antifungal agent (for example, those compounds which are described in H. Horiguchi, *Bokin Bobai no Kagaku* (*Antibacterial and Antifungal Chemistry*); Japanese Patent Application No. 253807/85, etc.), a washing accelerating agent (e.g., a sulfite salt, etc.), a chelating agent, etc.

According to the above-described process, developed and fixed photographic materials are washed with water and dried. Washing with water is conducted until almost all of the silver salts dissolved by fixing are removed, and is conducted preferably at about 50° C. to about 20° C. for 10 seconds to 3 minutes. Drying is conducted at about 40° C. to about 100° C. Drying time is properly varied depending upon the ambient condition, but is usually about 5 seconds to about 3 minutes and 30 seconds.

Roller-conveying type automatic developing processors are described in U.S. Pat. Nos. 3,025,779, 3,545,971, etc., and are merely referred to as roller-conveying type processors in this specification. Roller-conveying type processors involve the four steps of development, fixing, washing with water, and drying. In the present invention, too, this four step manner is most preferable, though other steps (for example, stopping step) may be involved in addition. The water-washing step may be conducted in a 2- to 3-stage countercurrent manner to save water.

The developer to be used in the present invention is preferably stored by wrapping in a wrapping material having a low oxygen permeability and described in Japanese Patent Application (OPI) No. 73902/86. The developer-replenishing system described in U.S. patent application Ser. No. 919,077 may preferably be applied to the developer to be used in the present invention.

The silver halide photographic material of the present invention provides such a high Dmax that, when subjected to reduction processing after formation of image, high density can be obtained even if halftone dot area is decreased.

The reducer to be used in the present invention is not particularly limited, and those described in Japanese Patent Application (OPI) Nos. 27543/75, 68429/77, 17123/80, 79444/80, 10140/82, 142639/82, 61155/86, etc., may be used as well as those described in books such as Mees, *The Theory of the Photographic Process*, pp. 738–744 (1954, Macmillan), Tetsuo Yano, *Photographic Processing Theory and Practice Thereof*, pp. 166–169 (1978, Kyoritsu Shuppan), etc. That is, a reducer containing as an oxidizing agent a permanganate, a persulfate, a ferric salt, a cupric salt, a ceric salt, red prussiate, a dichromate, etc., may be used alone or in combination and, if necessary, an inorganic acid such as sulfuric acid or an alcohol, or a reducer containing an oxidizing agent such as a red prussiate or ferric ethylenediaminetetraacetate, a silver halide solvent such as a thiosulfate, a rhodanide, a thiourea, or a derivative thereof and, if necessary, an inorganic acid such as sulfuric acid, and the like, may be used.

Typical examples of the reducer to be used in the present invention include so-called Farmer's reducer, a ferric ethylenediaminetetraacetate reducer, a potassium permanganate reducer, an ammonium persulfate reducer (Kodak R-5), and a ceric salt reducer.

In general, reduction processing is preferably completed at 10° C. to 40° C., particularly 15° C. to 30° C., within several seconds to several ten minutes, particularly several minutes. The light-sensitive material for a photomechanical process of the present invention permits sufficiently high reduction width within the above range.

The reducer acts on the silver image formed in an emulsion layer through a light-insensitive upper layer which may contain the compound of the present invention.

Specifically, there are various methods. For example, a method of dipping the light-sensitive material for a photomechanical process in the stirred reducer, a method of applying the reducer to the surface of light-insensitive upper layer of the light-sensitive material for a photomechanical process using a writing brush, a brush, a roller or the like.

The present invention is now illustrated in greater detail by reference to the following examples which, however, are not to be construed as limiting the present invention in any way.

EXAMPLE 1

Emulsions A, B and C were prepared as follows.

Emulsion A

A silver nitrate aqueous solution and an aqueous solution of potassium iodide and potassium bromide were simultaneously added to a gelatin aqueous of iridium hexachloride per mol of silver and ammonia in 60 minutes during which pAg of the solution was kept at 7.8. Thus, a cubic monodispersed emulsion of 0.3 μm mean grain size and 1 mol % mean silver iodide content was prepared.

Emulsion B

In the same manner as with Emulsion A, a cubic monodispersed emulsion of 0.22 μm mean grain size and 0.1 mol % mean silver iodide content was prepared by adjusting the amounts of potassium iodide and ammonia. Emulsions A and B were desalted by the flocculation method.

Emulsion C

An emulsion having been subjected to the same grain formation and desalting as with Emulsion B was sulfur-sensitized with hypo to prepare a cubic monodispersed sulfur-sensitized emulsion of 0.19 μm mean grain size and 0.1 mol % mean silver iodide content.

To these silver bromoiodide emulsions were added sodium salt of 5,5'-dichloro-9-ethyl-3,3'-bis(3-sulfopropyl)oxacarbocyanine as a sensitizing dye, 4-hydroxy-6-methyl-1,3,3a,7-tetraazaindene as a stabilizer, ascorbic acid, a polyethyl acrylate dispersion, and 1,3-divinylsulfonyl-2-propanol. Then, Emulsions A and B, or A and C were mixed in the silver halide weight ratios shown in Table 1 and, after adding thereto Compound (I-12) of the present invention included in general formula (I), each of the resulting emulsions was coated on a polyethylene terephthalate film in a silver amount of 3.4 g/m$^2$. Each sample was exposed under a light source of 3,200° K. color temperature for 5 seconds, and developed to measure photographic properties.

Dispersion coefficients ((standard deviation/mean grain size)×100) showing the degree of size distributions of Emulsions A, B and C, and the degree of increase in sensitivity by gold intensification of Samples 1, 3, and 5 prepared by coating Emulsions A, B, or C are tabulated below. Additionally, a gold intensification test was conducted in the manner described in this specification.

| Emulsion | Dispersion Coefficient % | Increase in Sensitivity by Gold Intensification |
|---|---|---|
| A | 9.8 | 0.25 (Sample 1) |
| B | 11.4 | 0.20 (Sample 3) |
| C | 11.4 | 0.63 (Sample 5) |

Reducibility was evaluated as follows:

A commercially available gray contact screen for negative use (150 lines/inch) was closely superimposed on each sample and, after exposing the sample through a step wedge of 0.1 in step difference using a white tungsten light, each sample was developed at 38° C. for 30 seconds. Then, the samples were subjected to ordinary fixing, washing with water, and drying to form halftone dot images.

The thus obtained halftone dot strips were dipped in the following cerium type reducer (20° C.), and washed with water.

| Reducer: | |
|---|---|
| Cerium Sulfate | 25 g |
| Concentrated Sulfuric Acid | 30 g |
| Water to make | 1 liter |

Change in halftone dot area of the thus obtained halftone dot strips and density per halftone dot were measured by means of a microdensitometer. Halftone dots of 50% in dot area was subjected to the reducing treatment, and halftone dot area was measured when density of individual halftone dots became 2.5. The difference between the halftone areas was determined, which was used as a reduction width value.

As is clear from Table 1, Samples 9 to 12 in accordance with the present invention showed high sensitivity, high gradation, and high Dmax with sufficiently few black peppers, and showed greatly improved reducibility.

TABLE 1

| Sample No. | Emulsion Used A | B | C | Compound (I-12) Added Amount (mol/mol Ag) | Photographic Properties Relative Sensitivity | Contrast (γ) | Dmax | Black Peppers | Reducibility (%) | Remarks |
|---|---|---|---|---|---|---|---|---|---|---|
| 1 | 100 | — | — | $4 \times 10^{-3}$ | 100 | 13.5 | 3.8 | 5 | 12 | Comparison |
| 2 | 100 | — | — | $5 \times 10^{-3}$ | 110 | 15.0 | 4.2 | 4 | 12 | Comparison |
| 3 | — | 100 | — | $4 \times 10^{-3}$ | 40 | 16.5 | 4.6 | 5 | 15 | Comparison |
| 4 | — | 100 | — | $5 \times 10^{-3}$ | 45 | 16.5 | 4.9 | 5 | 17 | Comparison |
| 5 | — | — | 100 | $4 \times 10^{-3}$ | 50 | 17.0 | 6.0 | 4 | 24 | Comparison |
| 6 | — | — | 100 | $5 \times 10^{-3}$ | 58 | 19.0 | 6.2 | 3 | 26 | Comparison |
| 7 | 30 | 70 | — | $4 \times 10^{-3}$ | 79 | 14.0 | 4.5 | 5 | 13 | Comparison |
| 8 | 30 | 70 | — | $6 \times 10^{-3}$ | 85 | 16.0 | 4.7 | 4 | 14 | Comparison |
| 9 | 30 | — | 70 | $4 \times 10^{-3}$ | 89 | 18 | 5.8 | 4 | 22 | Invention |
| 10 | 30 | — | 70 | $5 \times 10^{-3}$ | 100 | 18.5 | 6.0 | 3.5 | 24 | Invention |
| 11 | 50 | — | 50 | $4 \times 10^{-3}$ | 98 | 17.0 | 5.5 | 5 | 20 | Invention |
| 12 | 50 | — | 50 | $5 \times 10^{-3}$ | 105 | 18.0 | 5.7 | 4 | 21 | Invention |

Relative sensitivity was presented as a relative value of reciprocal of an exposure amount giving a density of 1.5 by development at 38° C. for 30 seconds, taking the sensitivity of Sample 1 as 100.

Black pepper formation was evaluated in five grades by observation under a microscope, with "5" being the best quality and 37 1" the worst. Samples evaluated as "5" or "4" can be practically used, samples evaluated as "3" are not good, but may barely be practically used, and sample evaluated as "2" or "1" cannot be practically used. Samples having a quality between "4" and "3" were evalutated as "3.5". Evaluation on black peppers was conducted on samples having been developed at 38° C. for 40 seconds.

Additionally, the developer had the following formulation:

| Formulation of Developer: | |
|---|---|
| Hydroquinone | 35.0 g |
| N-Methyl-p-aminophenol ½Sulfate | 0.8 g |
| Sodium Hydroxide | 9.0 g |
| Potassium Tertiary Phosphate | 74.0 g |
| Potassium Sulfite | 90.0 g |
| Disodium Ethylenediaminetetraacetate | 1.0 g |
| 3-Diethylamino-1-propanol | 15.0 g |
| 5-Methylbenzotriazole | 0.5 g |
| Sodium Bromide | 3.0 g |
| Water to make | 1 liter |

-continued

| Formulation of Developer: | |
|---|---|
| pH adjusted to | 11.60 |

EXAMPLE 2

To each of Emulsions A, B and C prepared in Example 1 were added sodium salt of 5,5'-dichloro-9-ethyl-3,3'-bis(3-sulfopropyl)oxacarbocyanine as a sensitizing dye, 4-hydroxy-6-methyl-1,3,3a,7-tetraazaindene as a stabilizer, a dispersion of polyethyl acrylate, an aqueous latex of (a) represented by the following structural formula:

Aqueous Latex (a)

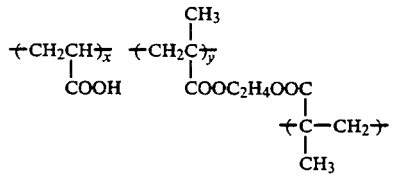

x/y = 70/30 (molar ratio)

and 1,3-divinylsulfonyl-2-propanol.

Then, Emulsions A and B or A and C were mixed with each other in the mixing ratios shown in Table 2 in terms of silver halide weight ratio and, after adding thereto Compound (I-28) of general formula (I) of the present invention as shown in Table 2, the resulting emulsions were respectively coated on a polyethylene terephthalate film in a silver amount of 3.2 g/m$^2$. Each sample was exposed and developed in the same manner as in Example 1 to measure photographic properties. The results thus obtained are tabulared in Table 2.

TABLE 2

| Sample No. | Emulsion Used A | B | C | Compound (I-28) Added Amount (mol/mol Ag) | Photographic Properties Relative Sensitivity | Contrast (γ) | Dmax | Black Peppers | Remarks |
|---|---|---|---|---|---|---|---|---|---|
| 13 | 100 | — | — | $1 \times 10^{-4}$ | 100 | 14 | 4.0 | 5 | Comparison |
| 14 | 100 | — | — | $1.4 \times 10^{-4}$ | 107 | 14.5 | 4.4 | 4.5 | Comparison |
| 15 | — | 100 | — | $1 \times 10^{-4}$ | 40 | 16 | 5.0 | 5 | Comparison |
| 16 | — | 100 | — | $1.4 \times 10^{-4}$ | 42 | 18 | 5.4 | 5 | Comparison |
| 17 | — | — | 100 | $1 \times 10^{-4}$ | 56 | 19.0 | 6.2 | 5 | Comparison |
| 18 | — | — | 100 | $1.4 \times 10^{-4}$ | 63 | 20.0 | 6.4 | 4.5 | Comparison |
| 19 | 30 | 70 | — | $1 \times 10^{-4}$ | 87 | 16 | 5.0 | 5 | Comparison |
| 20 | 30 | 70 | — | $1.4 \times 10^{-4}$ | 93 | 16.5 | 5.2 | 5 | Comparison |
| 21 | 30 | — | 70 | $1 \times 10^{-4}$ | 95 | 18.5 | 5.9 | 5 | Invention |
| 22 | 30 | — | 70 | $1.4 \times 10^{-4}$ | 100 | 19 | 6.0 | 5 | Invention |
| 23 | 50 | — | 50 | $1 \times 10^{-4}$ | 100 | 19.5 | 6.2 | 5 | Invention |
| 24 | 50 | — | 50 | $1.4 \times 10^{-4}$ | 105 | 19.5 | 6.2 | 5 | Invention |

As is clear from Table 2, in comparison with Comparative Samples 13 to 20, Samples 21 to 24 of the present invention did not undergo formation of serious black peppers and showed high sensitivity, high gamma, and high Dmax.

EXAMPLE 3

Larger Sized Grain Emulsion D and Smaller Sized Grain Emulsions E, F, G, H, I, J and K were prepared as follows:

Emulsion D

A silver nitrate aqueous solution and an aqueous solution of potassium iodide and potassium bromide were simultaneously added to a gelatin aqueous solution kept at 50° C. in the presence of a silver halide solvent (1.8-dihydroxy-3,6-dithiaoctane) in 40 minutes during which pAg of the solution was kept at 7.8. Thus, a cubic monodispersed emulsion of 0.28 μm mean grain size and 2 mol % mean silver iodide content was prepared. This emulsion was desalted by the flocculation method.

Emulsion E

A cubic monodispersed emulsion of 0.23 μm mean grain size and 1 mol % mean silver iodide content was prepared in the same manner as with Emulsion D by adjusting the amounts of potassium iodide and 1,8-dihydroxy-3,6-dithiaoctane, and desalted by the flocculation method.

Emulsion F

A cubic monodispersed emulsion of 0.23 μm mean grain size and 1 mol % mean silver iodide content was prepared in the same manner as with Emulsion E in the presence of $4 \times 10^{-7}$ mol of iridium hexachloride per mol of silver, and desalted by the flocculation method.

Emulsion G

A cubic monodispersed emulsion of 0.20 μm mean grain size and 1 mol % mean silver iodide content was prepared in the same manner as with Emulsion E by adjusting the amount of 1,8-dihydroxy-3,6-dithiaoctane, and was desalted by the flocculation method. Then, the emulsion was subjected to sulfur sensitization with hypo, and a 1% KI aqueous solution was added in an amount corresponding to 0.1 mol %, followed by conducting conversion for 10 minutes.

Emulsion H

A silver sulfate aqueous solution and an aqueous solution of potassium iodide and potassium bromide were simultaneously added in 80 minutes to a gelatin aqueous solution kept at 70° C. in the absence of a silver halide solvent during which pAg of the solution was kept at 7.6. Thus, a cubic monodispersed emulsion of 0.22 μm mean grain size and 1 mol % mean silver iodide content was prepared, then desalted by the flocculation method and subjected to sulfur sensitization with hypo.

Emulsion I

A silver nitrate aqueous solution and an aqueous solution of a mixture of sodium chloride and potassium bromide containing $2.7 \times 10^{-7}$ mol of rhodium ammonium chloride per mol of silver were simultaneously added in 30 minutes at a constant rate to a gelatin aqueous solution of 4.0 in pH kept at 40° C. to prepare a monodispersed silver chlorobromide emulsion of 0.23 μm mean grain size (bromide content: 30 mol %).

This emulsion was desalted by the flocculation method, then subjected to sulfur sensitization with hypo.

Emulsion J

A silver nitrate aqueous solution and an aqueous solution of potassium iodide and potassium bromide were added in the same manner as with Emulsion F at the same time in 40 minutes during which pAg was kept at 8.3. Thus, an octahedral monodispersed emulsion of 0.2 μm mean grain size and 1 mol % mean silver iodide content was prepared, then desalted and subjected to sulfur sensitization with hypo.

Emulsion K

A cubic monodispersed emulsion of 0.25 μm mean grain size and 1 mol % mean silver iodide content was prepared in the same manner as with Emulsion E, then desalted by the flocculation method, and subjected to sulfur sensitization with hypo.

The same additives as used in Example 1 were added to each of these emulsions, and Emulsion A of Example 1 was mixed with Emulsion D, E, F, G, H, I, J or K in the mixing ratio as shown in Table 3 in terms of weight ratio of silver halide. Then, Compound (I-12) of the present invention included in general formula (I) was added thereto in an amount of $5\times10^{-3}$ mol per mol of silver, and each of the resulting emulsions was coated on a polyethylene terephthalate film in a silver amount of 3.0 g/m$^2$. Each sample was subjected to the same test as in Example 1, and the results thus obtained are tabulated in Table 3. As is clear from Table 3, Samples 35 to 39 and 41 to 45 of the present invention formed fewer black peppers and showed higher sensitivity, higher Dmax, and better reducibility than the comparative samples. Emulsion K (Sample 33) having been subjected to independent sulfur sensitization to increase sensitivity and Dmax suffered formation of serious black peppers. Iridium-sensitized emulsions (Samples 35 and 41) showed the same effects though not reaching the degree attained by sulfur sensitization.

EXAMPLE 4

The same results as in Example 1, Table 1, were obtained when adsorptive hydrazine (I-36) or ballast group-free (I-19) was used in place of hydrazine (I-12) in Example 1.

EXAMPLE 5

Emulsion (I) was prepared by adding a sensitizing dye of 5,5'-dichloro-9-ethyl-3,3'-bis(3-sulfopropyl)oxacarbocyanine to Emulsion C of Example 1 in the post period of sulfur sensitization at a temperature of 50° C. When this emulsion was combined with Emulsion A and subjected to the same tests as in Example 1, there were also obtained good results with regard to black peppers, Dmax, and reducibility.

EXAMPLE 6

When the sulfur sensitizing agent used in Emulsion C of Example 1, hypo, was changed to triethylthiourea or 5-benzylidene-3-ethylrhodanine, good results were obtained as well.

While the invention has been described in detail and with reference to specific embodiments thereof, it will be apparent to one skilled in the art that various changes and modifications can be made therein without departing from the spirit and scope thereof.

What is claimed is:

1. A silver halide photographic material, comprising:

a support having provided thereon at least one silver halide emulsion layer; and a hydrazine derivative contained in said emulsion layer or in at least one other hydrophilic colloidal layer, wherein said emulsion layer comprises:

a first monodispersed silver halide emulsion containing large monodispersed silver halide grains, wherein said large monodispersed silver halide grains are not chemically sensitized; and a second monodispersed silver halide emulsion containing small monodispersed silver halide grains, wherein said small monodispersed silver halide grains are chemically sensitized by means of at least one process selected from the group consisting of a

TABLE 3

| Sample | Used Emulsion | | | | | | | | | Photographic Properties | | | | Reduci- | |
|---|---|---|---|---|---|---|---|---|---|---|---|---|---|---|---|
| | | | | | | | | | | Relative | Contrast | | Black | bility | |
| No. | A | D | E | F | G | H | I | J | K | Sensitivity | (γ) | Dmax | Peppers | (%) | Remarks |
| 25 | 100 | — | — | — | — | — | — | — | — | 100 | 15.0 | 3.9 | 4.5 | 12 | Comparison |
| 26 | — | 100 | — | — | — | — | — | — | — | 102 | 16.0 | 3.8 | 4.5 | 10 | Comparison |
| 27 | — | — | 100 | — | — | — | — | — | — | 40 | 16.5 | 4.7 | 5 | 15 | Comparison |
| 28 | — | — | — | 100 | — | — | — | — | — | 45 | 17.0 | 5.6 | 5 | 18 | Comparison |
| 29 | — | — | — | — | 100 | — | — | — | — | 58 | 18.0 | 6.1 | 3 | 22 | Comparison |
| 30 | — | — | — | — | — | 100 | — | — | — | 58 | 18.6 | 6.0 | 3 | 22 | Comparison |
| 31 | — | — | — | — | — | — | 100 | — | — | 50 | 19.2 | 6.0 | 1.5 | 24 | Comparison |
| 32 | — | — | — | — | — | — | — | 100 | — | 58 | 17.4 | 6.0 | 3 | 20 | Comparison |
| 33 | — | — | — | — | — | — | — | — | 100 | 102 | 19.0 | 6.1 | 1 | 22 | Comparison |
| 34 | 30 | — | 70 | — | — | — | — | — | — | 72 | 16.8 | 4.4 | 5 | 13 | Comparison |
| 35 | 30 | — | — | 70 | — | — | — | — | — | 89 | 17.2 | 5.2 | 5 | 17 | Invention |
| 36 | 30 | — | — | — | 70 | — | — | — | — | 195 | 17.4 | 5.9 | 4 | 21 | Invention |
| 37 | 30 | — | — | — | — | 70 | — | — | — | 92 | 17.0 | 5.8 | 4 | 21 | Invention |
| 38 | 30 | — | — | — | — | — | 70 | — | — | 95 | 17.2 | 5.9 | 3 | 21 | Invention |
| 39 | 30 | — | — | — | — | — | — | 70 | — | 98 | 16.0 | 5.7 | 4.5 | 19 | Invention |
| 40 | — | 30 | 70 | — | — | — | — | — | — | 75 | 15.8 | 4.5 | 5 | 11 | Comparison |
| 41 | — | 30 | — | 70 | — | — | — | — | — | 89 | 16.6 | 5.1 | 5 | 16 | Invention |
| 42 | — | 30 | — | — | 70 | — | — | — | — | 98 | 17.0 | 5.8 | 4 | 20 | Invention |
| 43 | — | 30 | — | — | — | 70 | — | — | — | 98 | 17.6 | 5.7 | 4 | 20 | Invention |
| 44 | — | 30 | — | — | — | — | 70 | — | — | 92 | 16.8 | 5.9 | 3.5 | 22 | Invention |
| 45 | — | 30 | — | — | — | — | — | 70 | — | 98 | 17.0 | 5.6 | 4.5 | 19 | Invention |

sulfur-sensitization process and a gold-sensitization process, wherein said small and large monodispersed silver halide grains differ from each other in mean grain size, wherein the mean grain size of said small monodispersed silver halide grains is 90% or less of that of said large monodispersed silver halide grains, wherein said large and small monodispersed silver halide grains have mean grain sizes of from 0.02 to 0.5 μm, and wherein said first monodispersed silver halide emulsion and said second monodispersed silver halide emulsion have a sensitivity difference of from 0.1 to 1.0 Δ log E.

2. The silver halide photographic material as claimed in claim 1, wherein the sensitivity difference between the first monodispersed emulsion and the second monodispersed emulsion is 0.2 to 0.7 Δlog E.

3. The silver halide photographic material as claimed in claim 1, wherein said small mono-dispersed silver halide grains are sulfur-sensitized.

4. The silver halide photographic material as claimed in claim 1, wherein the mean grain size of said small monodispersed silver halide grains is 80% or less of that of said larger monodispersed silver halide grains.

5. The silver halide photographic material as claimed in claim 1, wherein the two kinds of monodispersed silver halide grains have mean grain sizes of 0.1 to 0.4 μm.

6. The silver halide photographic material as claimed in claim 1, wherein said second monodispersed silver halide emulsion is coated in a silver amount of 40 to 90 wt % based on the amount of total coated silver.

7. The silver halide photographic material as claimed in claim 6, wherein said second monodispersed silver halide emulsion is coated in a silver amount of 50 to 80 wt % based on the amount on the total coated silver.

8. The silver halide photographic material as claimed in claim 1, wherein the amount of total coated silver is 1 $g/m^2$ to 8 $g/m^2$.

9. A method for forming an image using a silver halide photographic material comprising:

a support having provided thereon at least one silver halide emulsion layer; and a hydrazine derivative contained in said emulsion layer on in at least one other hydrophilic colloidal layers, wherein said emulsion layer comprises:

a first monodispersed silver halide emulsion containing large monodispersed silver halide grains, wherein said large monodispersed silver halide grains are not chemically sensitized; and a second monodispersed silver halide emulsion containing small monodispersed silver halide grains, and said small monodispersed silver halide grains are chemically sensitized by means of at least one process selected from the group consisting of a sulfur-sensitization process and a gold-sensitization process, wherein said small and large monodispersed silver halide grains differ from each other in mean grain size, wherein the mean grain size of said small monodispersed silver halide grains is 90% or less of that of said large monodispersed silver halide grains, wherein said large and small monodispersed silver halide grains have mean grain sizes of from 0.02 to 0.5 μm, and wherein said first monodispersed silver halide emulsion and said second monodispersed silver halide emulsion have a sensitivity difference of from 0.1 to 1.0 Δ log E, wherein said method comprises the steps of: imagewise exposing said silver halide photographic material; and processing the resulting imagewise exposed material in a developer containing 0.15 mol/liter or more sulfite ion and having a pH of 0.5 to 12.3.

10. The image-forming method as claimed in claim 9, wherein the sensitivity difference between the first monodispersed emulsion and the second monodispersed emulsion is 0.2 to 0.7 Δlog E.

11. The image-forming method as claimed in claim 9, wherein said small monodispersed silver halide grains are sulfur-sensitized.

12. The image-forming method as claimed in claim 9, wherein the mean grain size of said smaller monodispersed silver halide grains is 80% or less of that of said large monodispersed silver halide grains.

13. The image-forming method as claimed in claim 9, wherein the two kinds of monodispersed silver halide grains have mean grain sizes of 0.1 to 0.4 μm.

14. The image-forming method as claimed in claim 9, wherein said second monodispersed silver halide emulsion is coated in a silver amount of 40 to 90 wt % based on the amount of total coated silver.

15. The image-forming method as claimed in claim 14, wherein said second monodispersed silver halide emulsion is coated in a silver amount of 50 to 80 wt % based on the amount of the total coated silver.

16. The image-forming method as claimed in claim 9, wherein the amount of total coated silver is 1 $g/m^2$ to 8 $g/m^2$.

* * * * *